United States Patent [19]

Simons

[11] Patent Number: 4,561,405

[45] Date of Patent: Dec. 31, 1985

[54] CONTROL OF FUEL INJECTION APPARATUS FOR INTERNAL COMBUSTION ENGINES

[75] Inventor: Peter W. Simons, East Fremantle, Australia

[73] Assignee: Orbital Engine Company Proprietary Limited, Balcatta, Australia

[21] Appl. No.: 682,589

[22] Filed: Dec. 17, 1984

Related U.S. Application Data

[63] Continuation of Ser. No. 454,656, Dec. 30, 1982, abandoned.

[30] Foreign Application Priority Data

Dec. 31, 1981 [AU] Australia ..... PF2125

[51] Int. Cl.[4] ..... F02M 17/00; F02M 9/08; F02M 23/00

[52] U.S. Cl. ..... 123/531; 123/478; 123/492; 123/494

[58] Field of Search ..... 123/472, 494, 492, 478, 123/531

[56] References Cited

U.S. PATENT DOCUMENTS

| | | | |
|---|---|---|---|
| 3,319,613 | 5/1967 | Begley et al. | 123/482 |
| 3,626,910 | 12/1971 | Porsche et al. | 123/492 |
| 3,643,635 | 2/1972 | Milan | 123/482 |
| 3,661,126 | 5/1972 | Baxendale | 123/492 |
| 3,724,435 | 4/1973 | Bier | 123/482 |
| 3,913,547 | 10/1975 | Wentworth et al. | 123/482 |
| 3,933,135 | 1/1976 | Zillman et al. | 123/482 |
| 3,935,851 | 2/1976 | Wright et al. | 123/482 |
| 3,949,713 | 4/1976 | Rivere | 123/482 |
| 4,048,964 | 9/1977 | Kissel | 123/482 |
| 4,153,014 | 5/1979 | Sweet | 123/492 |
| 4,224,904 | 9/1980 | Clark | 123/531 |
| 4,343,280 | 8/1982 | Luscomb | 123/458 |
| 4,398,518 | 8/1983 | LeBlanc et al. | 123/458 |
| 4,404,943 | 9/1983 | Seilly | 123/458 |
| 4,436,071 | 3/1984 | Hafner et al. | 123/472 |
| 4,462,760 | 7/1984 | Sarich et al. | 123/531 |

FOREIGN PATENT DOCUMENTS

| | | | |
|---|---|---|---|
| 1751524 | 2/1970 | Fed. Rep. of Germany | 123/492 |
| 1149073 | 4/1969 | United Kingdom | 123/492 |
| 1272595 | 5/1972 | United Kingdom | 123/492 |
| 1305612 | 2/1973 | United Kingdom | 123/492 |
| 1319671 | 6/1973 | United Kingdom | 123/492 |

*Primary Examiner*—Raymond A. Nelli
*Attorney, Agent, or Firm*—Murray, Whisenhunt and Ferguson

[57] ABSTRACT

A fuel injection apparatus for an internal combustion engine comprising a metering device to adjust the quantity of fuel delivered each cycle of the device in response to conditions in the engine induction passage, a control activating said device to effect a base number of delivery cycles to the engine, and a sensor responsive to transient engine conditions to increase the number of cycles of the metering device above the base number per engine revolution.

2 Claims, 3 Drawing Figures

CONTROL OF FUEL INJECTION APPARATUS FOR INTERNAL COMBUSTION ENGINES

This application is a continuation of application Ser. No. 454,656, filed Dec. 30, 1982, now abandoned.

This invention relates to the control of fuel injection apparatus used to supply fuel to an internal combustion engine. There is currently in use a variety of systems for controlling the quantity of fuel injected to an internal combustion engine in accordance with the speed and load demands of the engine.

The presently-known systems may be loosely categorised into mechanical and electronic systems, the distinction being that whereas mechanical systems generally meter fuel by a combination of dynamic responses to mechanical and physical effects, electronic systems generally allow sensed information to be processed in a sophisticated manner by electronic circuitry in order to arrive at the metered fuel quantity. Often, mechanical systems have the advantage of simplicity and relatively low costs in a given engine control application but may have disadvantages which include lack of response to sudden and short term variations in fuel demand. The fully electronic systems have the capability to respond quickly to a wide range of engine conditions, however, electronic systems may not be cost-effective in some applications, especially where improved control is of little practical benefit. In engines not subject to severe exhaust emission constraints the benefit of improved control may be outweighed by the increase in costs. Additionally electronic systems require high skill in regard to maintenance and repair.

There has been proposed in various prior published patent specifications to provide a fuel injection system wherein the quantity of fuel admitted each cycle is controlled by the period that an electronically operated nozzle valve is open to permit injection of the fuel. This basic type of system is referred to in British Pat. Nos. 1,107,989; 1,149,073 and U.S. Pat. No. 3,626,910.

All of these systems rely upon the use of an injector nozzle having an electro-magnetically operated valve and to which fuel is constantly supplied at a set pressure by a suitable fuel pump. Appropriate electronic controls determine the fuel demand of the engine in accordance with selected engine operating parameters and hence deliver a signal to the electro-magnetically controlled valve so that the valve is held open for a period depending upon the fuel demand of the engine. As the fuel supply to the valve is at a constant pressure the quantity of fuel delivered is directly proportional to the duration of the opening of the valve. A suitable triggering mechanism is provided which operates in accordance with the speed of the engine to time the opening of the electronically controlled valve relative to the engine cycle so that the fuel is delivered at the correct point in the engine cycle.

In British Pat. No. 1,149,073 it is proposed to subdivide each injection period into a number of elementary injections so as to obtain better mixing of the fuel with the air and hence more complete combustion. In this proposal, each and every injection is sub-divided into a number of elementary injections, irrespective of the load conditions on the engine, and variations in load conditions and other controlling factors are taken into account by varying the number and duration of each elementary injection so that for each injection the total required amount of fuel is injected.

This system does not incorporate provision for the specific introduction of additional fuel under specified conditions, such as acceleration, but merely relies on the overall control system to respond to the changed engine conditions by an appropriate increase in the total duration of each injection period.

The principal of sub-dividing each injection period into a number of elementary injections is also employed in the injection system proposed in U.S. Pat. No. 3,626,910 and again it is adopted for the purposes of obtaining improved fuel mixing and combustion. However, in this proposal the sub-dividing of each injection into a number of elementary injections occurs during the lower speed range of the engine, and as the engine speed increases, the number of elementary injections decreases, until at high speed operation a single continuous injection takes place to supply the total amount of fuel required.

Again, as in the proposal of British Pat. No. 1,149,073, no specific provision is made for supplying additional injections of fuel during severe load conditions, such as acceleration, and the basic control system is relied upon to increase the total time of injection on each cycle in accordance with the operating conditions of the engine.

British Pat. Nos. 1,272,595; 1,305,612 and 1,319,671 each relate to proposals whereby the basic fuel injection system as disclosed in British Pat. Nos. 1,107,989 and 1,149,073 are modified so that further pulses of electrical energy are provided to the electro-magnetically operated fuel injection valve, when the engine is required to accelerate, so as to increase the total period which the valve is open during each injection cycle and therefore increase the total amount of fuel delivered.

All of the injection systems disclosed in the various prior art specifications discussed herein require a comparatively expensive electronic processor to receive signals in accordance with the state of various engine operating parameters and to then analyse this information and produce a signal which will result in the electro-magnetic nozzle valve being opened for the required duration to deliver the necessary fuel to meet the engine demand. Where provision is made to provide additional deliveries of fuel under selected load conditions, such as acceleration, there is required further electronic equipment to produce the necessary signals and the processor must be of a more complicated nature to be able to handle the additional input and produce the required additional output signals. This type of control system for fuel injection is acceptable in the more expensive motor vehicles and particularly in motor vehicles which already incorporate processors for controlling electrical circuits and other functions of the vehicle. However, the costs involved in supplying such equipment is not acceptable in the low to medium price range of motor vehicles, even though it is is desirable to adopt fuel injection systems in such vehicles in order to simplify the compliance with current pollution control regulations.

It is the object of the present invention to provide a fuel injection apparatus which may be controlled by comparatively simple mechanisms and has improved response characteristics compared with some current systems.

With the above stated object in view there is provided a fuel injection apparatus for an internal combustion engine having one or more combustion chambers comprising an injector nozzle for each combustion chamber, the nozzle having a fixed size constantly open orifice, means to deliver metered quantities of fuel to the nozzle for admission to the combustion chamber, means to adjust said metered quantity in response to a selected condition in the engine air induction system, means to activate said delivery means in response to the engine speed, said activating means being adapted to effect a base number of deliveries to each combustion chamber per engine cycle, and means to increase the number of deliveries per cycle to at least one combustion chamber in response to a selected engine fuel demand.

The means to adjust the metered quantity of fuel is preferably operable in response to the pressure and/or the velocity of the air in the induction passage of the engine. These means may be a mechanical mechanism including a fluid motor responsive to the pressure and/or speed or mass flow of the air in the induction passage. The motor drives a member, the movement of which varies the metered quantity of fuel delivered to the nozzle. The motor may comprise a piston or diaphragm mounted in a chamber and urged by resilient means to move in one direction, with the air induction pressure applied to the piston or diaphragm to induce movement in the opposite direction as said pressure decreases.

Conveniently there is provided a fuel injection apparatus for an internal combustion engine having one or more combustion chambers comprising an injector nozzle for each combustion chamber, the nozzle having a fixed size constantly open orifice, means to deliver metered quantities of fuel to the nozzle for admission to the combustion chamber, mechanical means to adjust said metered quantity in response to a selected condition in the engine air induction system, electrically operable means to activate said delivery means in response to the engine speed, said activating means being adapted to effect a base number of deliveries of metered quantities of fuel to each combustion chamber per engine cycle, and means responsive to at least one selected engine operating condition to increase the number of deliveries per cycle of metered quantities of fuel to at least one combustion chamber.

The means to activate the delivery means may be controlled by electrical pulses generated proportional to engine speed. The number of pulses generated per revolution is preferably a multiple of the base number of deliveries per revolution. Under steady load conditions a proportion of the pulses generated are depressed, so the number of pulses applied to the delivery activating means is equal to the base number of deliveries. Upon the selected engine fuel demand arising the proportion of pulses applied to the delivery activating means per engine cycle is increased to thereby increase the number of fuel deliveries per engine cycle.

The delivery means is preferably solenoid operated and arranged to be activated to deliver a metered quantity of fuel once for each cycle of the solenoid. The solenoid may be cycled once for each pulse received, or proportional to the number of pulses received.

It will be understood that the present proposal is to adjust the metered quantity of fuel in order to accommodate normal load variations which are of gradual nature and so do not require rapid and large variations in the metered quantity of fuel. When rapid and/or substantial load variations occur these are accommodated by varying the number of deliveries of the metered quantity of fuel as this variation can be effected more rapidly than a large variation in the actual metered quantity of fuel. However, when rapid and/or substantial load variations occurs there will of course be initiated an adjustment to the metered quantity of fuel as that load variation will be reflected in the conditions in the air induction passage of the engine. This adjustment is comparatively slow and so the additional fuel required to meet this load variation will be derived from the additional deliveries of the metered quantity of fuel. The additional deliveries will cease as the adjustment to the metered quantity of fuel becomes effective to meet the new engine load. It is therefore seen that the additional deliveries of fuel provide the rapid response to the variation in load, while the adjustment to the metered quantity of fuel is in progress to meet the new load conditions.

Sudden decreases in load and hence fuel demand may also occur, and in such instances there may be a delay in the necessary correction to the metered quantity of fuel. In this situation the means to activate delivery of the metered quantities of fuel may be arranged to decrease the number of deliveries per engine cycle.

The means for delivering the predetermined quantity of fuel may be the metering and injection apparatus as disclosed in U.S. Pat. No. 4,462,760, which is hereby incorporated by reference, and a solenoid operated valve may be used in conjunction therewith to activate the delivery of the metered quantity of fuel.

The engine demands which may call for an increase in the number of deliveries of metered quantity of fuel per engine cycle, include such demands as acceleration of the engine, particularly when accelerating from idling speed, low engine temperature, and engine mode of operation, such as cranking at starting. The existence of these demands may be sensed by a variety of currently known sensing devices, such as potentiometers, which vary the voltage or the rate of change of voltage applied to an electronic controller, temperature sensors, and the voltage condition of starting circuits, for example.

In regard to the sensing of a demand for additional fuel during acceleration, a potentiometer can be coupled to the drive operated accelerator, so that if the rate of movement of the accelerator exceeds a predetermined value the controller will increase the number of pulses fed to the solenoid, and hence the number of solenoid cycles per engine cycle will increase and the fuel supply to the engine will correspondingly increase. The controller may be arranged so that there is an increase in the fuel supply over only one cycle of the engine, or over a number of cycles, which number may vary in accordance with the rate of acceleration demanded by the accelerator. The additional deliveries of fuel may continue over a number of engine cycles at a constant or varying rate.

The invention will be more readily understood from the following description of one practical arrangement of the fuel control system in accordance with the present invention, as illustrated in the accompanying drawings.

In the drawings

Figure 1:
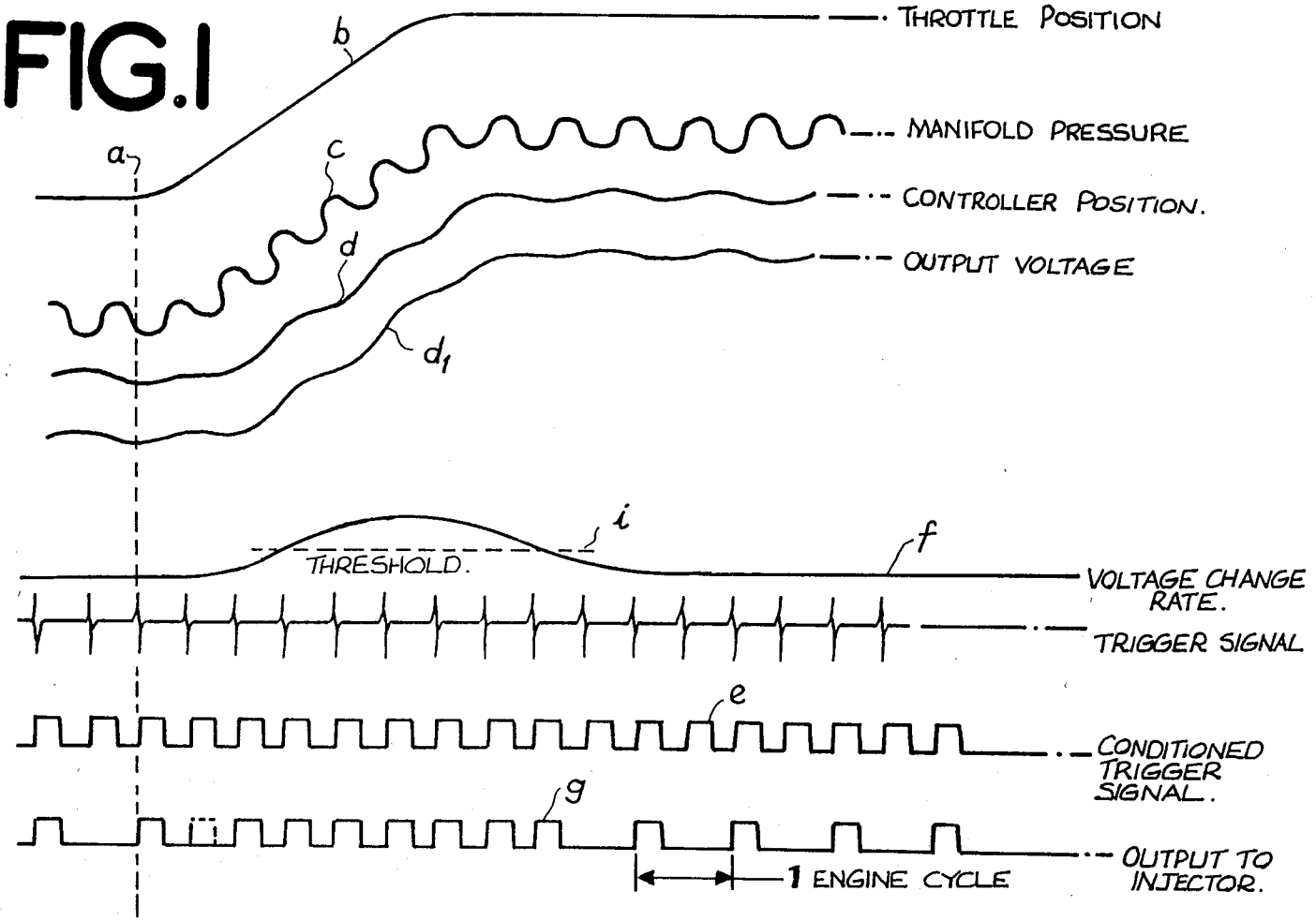
FIG. 1 is a diagrammatic representation of operation of the invention.

Referring now to FIG. 1 of the drawings, there is illustrated therein diagrammatically the manner in which the load conditions of the engine are monitored, and when a rapid change in load conditions is detected, how this is applied to produce the additional delivery or deliveries of measured quantities of fuel. The diagram illustrates the engine running at idling speed and then accelerating to a higher steady speed.

The vertical broken line (a) indicates the point of initiation of movment of the throttle from the idle position towards the higher steady speed condition. As the throttle moves through the transition positions indicated by the inclined line (b) there will be a corresponding steady average increase in the sub-atmospheric pressure in the air induction manifold of the engine as indicated at (c). The actual pressure varying during this transition period in accordance with the cycling of the combustion chamber to which the manifold is connected.

The vertical broken line (a) indicates the point of initiation of movement of the throttle from the idle position towards the higher steady speed condition. As the throttle moves through the transition positions indicated by the inclined line (b) there will be a corresponding steady average increase in the absolute pressure in the air induction manifold of the engine as indicated at (c). The actual pressure varying during this transition period in accordance with the cycling of the combustion chamber to which the manifold is connected.

The means controlling the metered quantity of fuel delivered to the engine is responsive to the pressure in the inlet manifold of the engine and accordingly during the transition period the metered quantity of fuel available for admission to the engine will increase as indicated by line (c) in FIG. 1.

A potentiometer is incorporated in the mechanism which adjusts the metered quantity of fuel so that the output voltage from the potentiometer is related to the metered quantity of fuel. Thus the output voltage of the potientionmeter will vary in the same manner as the metered quantity of fuel varies and is represented by the line (d) in FIG. 1. The output voltage from the potentiometer is fed to a controller and the rate of change of this voltage determined at fixed reference points in the engine cycle. The engine is provided with a trigger signal generator arranged to deliver two trigger signals each cycle of the engine which in a four-stroke engine is one trigger signal per revolution of the engine. The trigger signals are used to produce a pulsating voltage (e) that may be applied to a suitable electrically controlled device such as a solenoid to time the deliveries of fuel in relation to the rotation of the engine so that without further processing the solenoid would be activated twice each engine cycle. The trigger signal and the resulting control voltage is also used to time the point of delivery of the metered quantity of fuel within the engine cycle.

The controller is arranged so that under normal steady load conditions of the engine, only each alternate control voltage pulse is applied to the solenoid or other electrical device regulating the delivery of the metered quantity of fuel so that under these steady load conditions there is only one metered quantity of fuel delivered to the engine during each engine cycle. The controller determines whether steady load conditions exist by comparing the rate of change of the output voltage from the potentiometer as illustrated by line ($d_1$) each half cycle of the engine, that is at each trigger signal, and if the rate of change of the voltage is above a predetermined value, then the additional control voltage pulses are not suppressed and permitted to be applied to the solenoid or other electrical control so that there would result in two metered quantities of fuel being delivered each cycle of the engine as compared with the single measured quantity delivered under steady load conditions. The line (g) in FIG. 1 indicates the actual control voltage pulses applied to the solenoid controlling the delivery of the metered quantities of fuel under the load conditions represented in FIG. 1 during transition from idling to a higher steady speed. Line (f) in FIG. 1 indicates the rate of change of the output voltage from the potentiometer and the predetermined threshhold of the rate of change is indicated by the horizontal broken line (i).

In the above discussed mode of operation of the regulation of the delivery of additional metered quantities of fuel, a switch may be provided in the potentiometer circuit so that when the throttle is in the idle position the switch is open. Thus the controller will not be able to make comparisons between the potentiometer output voltage each half cycle and thus there will be a steady state wherein there will only be one delivery of the metered quantity of fuel to the engine per engine cycle. This switch also enables the controller to be arranged to block all pulses of control voltage to the solenoid when the engine is decelerating after the throttle has been moved to the idle position. It will be appreciated that when the throttle is closed suddenly whilst the engine is runnning at a significant speed, there is a time delay in the engine falling to idle speed as a result of the inertia of the components of the engine. It is clear that no fuel is required to be delivered to the engine during this deceleration period and thus the controller can be arranged so that when the throttle switch is closed and the engine speed is above a predetermined figure, which is conveniently slightly above idle speed, all control voltage pulses will be suppressed so that there will be no deliveries of metered quantities of fuel to the engine. Once the engine speed has dropped below the predetermined minimum speed, which can be determined by the rate of the trigger signals received, the controller will again permit the control voltage pulses to be applied to the solenoid at the rate of one pulse per engine cycle so that there will be one delivery of a metered quantity of fuel per engine cycle.

Figure 2:
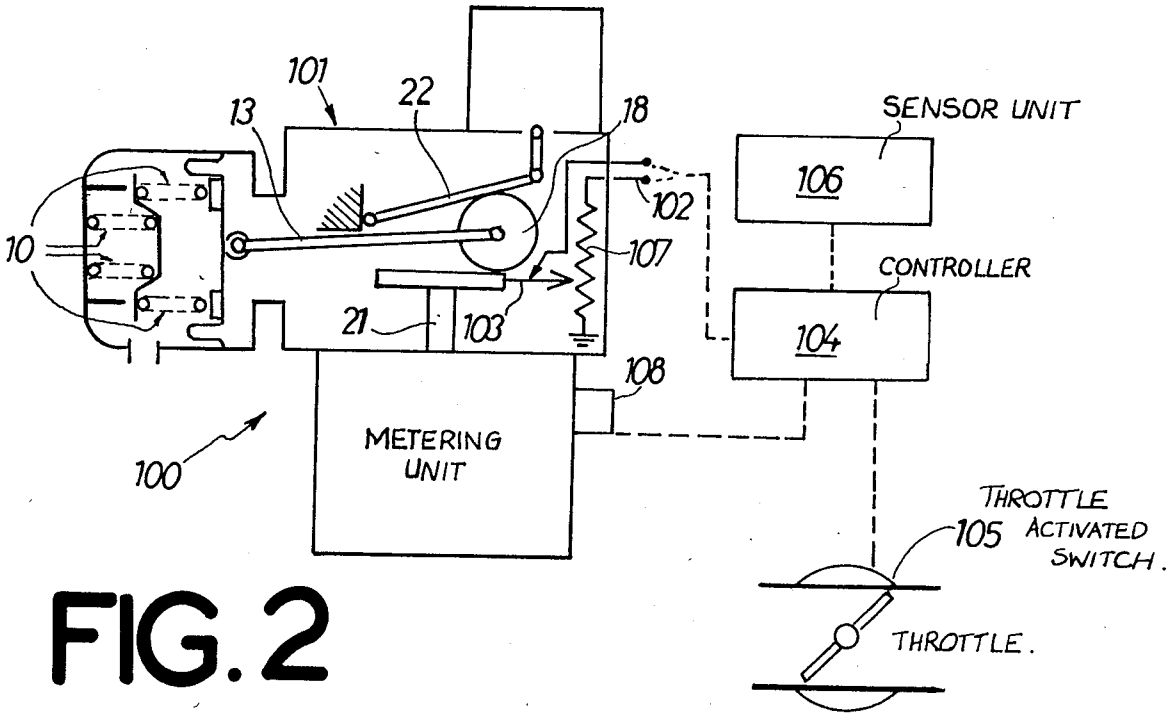
FIG. 2 is a diagrammatic layout of the control apparatus and associated equipment.

Referring now to FIG. 2 of the drawings wherein there is shown in block diagram form the components of the fuel control system of the present invention, particularly as described above in connection with FIG. 1. In this drawing the metering unit 100 has an induction manifold pressure operated mechanical mechanism 101 to regulate the quantity of each metered delivery of fuel to the engine. The various components of the mechanical mechanism shown diagrammatically in FIG. 2 have the same reference numeral as the corresponding component has as shown in more detail in FIG. 3. The potentiometer 102 has a movable wiper 103 mounted on the metering member 21 to cooperate with stationary resistance strip 107 (FIG. 3) and the variable voltage from the potentiometer is applied to the processor 104. The throttle off idle switch 105 is also coupled to the controller 104 so as to control the application of voltage to the potentiometer 102 as previously described. The speed sensor included in the sensor unit 106 is activated by a rotating portion of the engine such as its crankshaft to give trigger signals to the controller in accordance with the engine speed. The pulsing control voltages eminating from the controller are applied to the solenoid valve 108 to regulate the frequency of the deliveries of metered quantities of fuel to the engine.

Figure 3:
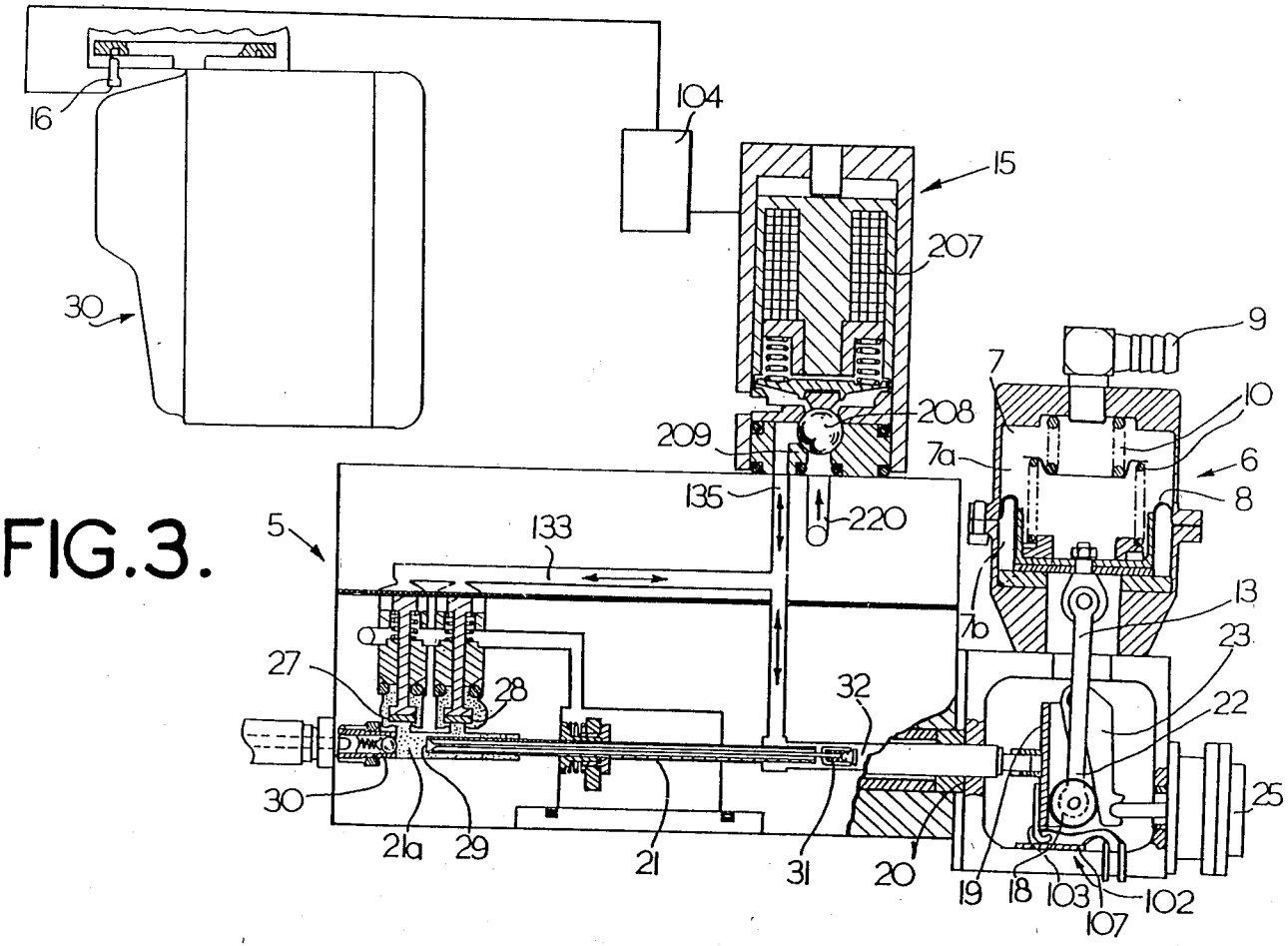
FIG. 3 is a side view partly in section of one embodiment of the apparatus according to the present invention.

Referring now to FIG. 3 of the accompanying drawing there is illustrated a fuel metering and injection device operating on the principle of the invention disclosed in the previously referred to U.S. Pat. No. 4,462,760, and indicated generally at 100, coupled to a mechanical control device 101 to affect adjustment of the quantity of fuel metered during each cycle of the injector. The solenoid operated air valve 108 controls the supply of air to the fuel and delivery valves of the fuel metering and injection device 100.

The mechanical control device 101 comprises a chamber section 7 divided into two sections by a diaphragm 8 with the chamber section 7*a* on one side of the diaphragm connectable via the coupling 9 to the air induction manifold of an engine. The below-atmospheric pressure in the manifold is thus applied to the chamber section 7*a* on one side of the diaphragm whilst atmospheric pressure exists in the chamber section 7*b* on the other side of the diaphragm. The springs 10 are located within the chamber section 7*a* to act upon the diaphragm to oppose the movement induced thereinto by the application of below-atmospheric pressure in the chamber section 7*a*. Accordingly, by an appropriate selection of the rate of springs 10, the movement of the diaphragm is proportional to the pressure existing in the induction manifold of the engine.

Portion of the diaphragm 8 is coupled with the rod 13 carrying separate co-axial rollers 18 at its free end. One of the rollers 18 engages the plate 19 which is attached to the rod 20 that actuates member 21 extending into the metering and injection device 100. The member 21 extends into the metering chamber 21*a* of the device 100 and the volume of fuel delivered each cycle is varied by the extent that the member 21 extends into the metering chamber. The other of the rollers 18 engage the inclined face 22 of the ramp 23 which during normal operation has a fixed position.

Accordingly it will be seen that as the pressure in the induction manifold decreases the rollers 18 will move upwardly as viewed in the drawing along the inclined face 22 of the ramp causing the rod 20 to move inwardly of the metering device and reduce the quantity of fuel metered during each cycle. As is known the pressure in the induction manifold of an engine decreases as the demand for fuel decreases, and accordingly, the roller 18 moves along the inclined face 22 in the direction to reduce the quantity of metered fuel per cycle as the pressure in the induction manifold decreases. In the embodiment shown the inclination of the inclined face 22 of the ramp 23 may be adjusted by the actuator 25 so that the rate of change of fuel quantity per unit of movement of the diaphragm 8 can be varied to suit particular engine operating conditions.

The extent of control applied to actuator 25 depends on the selected level of sophistication of control. The simplest arrangement is a mechanical actuator which is adjusted manually during cold start and warm-up. The most sophisticated are programmed control strategies which make corrections for variables such as engine speed, engine temperature, barometric pressure and ambient temperature. However, a temperature-sensitive element communicating engine temperature is commonly used as the most cost effective compromise in many applications.

The solenoid operated valve 108 controls the supply of air to the pneumatically operated fuel inlet and outlet valves 27 and 28, and the supply of air through the valve 29 to the metering chamber 21*a* of the metering and injection device 100. The sequency and manner of operation of these valves is disclosed in more detail in U.S. Pat. No. 4,462,760 hereinbefore referred to.

The quantity of fuel displaceable from the chamber 21*a* by the air is the fuel located in that portion of the chamber 21*a* located between the point of entry of the air to the chamber, and the point of discharge of the fuel from the chamber, this is the quantity of fuel between the air admission valve 29 and the delivery valve 30.

The air admission valve 29 at the end of the metering rod 21 located in the metering chamber 21*a* is normally held closed by the spring 31 to prevent the flow of air from the air supply chamber 32 to the metering chamber 21*a*. Upon the pressure in the chamber 32 rising to a predetermined value the valve 29 is opened to admit the air to the metering chamber 21*a*, and thus displace the fuel therefrom.

The pulse generator 16 may be of any of the known types available and is mounted on the engine 30 at a suitable location to generate pulses proportional to the speed of rotation of the engine. These pulses are then fed to an appropriate controller 104 arranged so that only the base number of pulses are fed to the solenoid 108 for each cycle of the engine at steady operating conditions. When it is required to increase the number of fuel deliveries per cycle of the engine the controller increases the number of pulses fed to the solenoid above the base number. Also the controller may be arranged for the period over which the increased number of pulses are fed to the solenoid to be varied such as for only one or a number of engine cycles. The operation of the processor has been described in more detail with reference to FIG. 1.

In one example of the present invention is applied to a four stroke four cylinder engine equiped with a fuel injector having four fuel metering units, one for each cylinder, each controlled by an individual solenoid valve. The pulse generator is arranged to produce four pulses per revolution of the engine and the controller is programmed to normally supress each alternate pulse. There is thus two pulses per revolution available for activation of the four solenoid valves. As the engine is a four stroke cycle each cylinder requires fuel only once each two revolutions. Accordingly with two pulses per revolution each of the four solenoid valves is activated once every two revolutions to deliver a measured quantity of fuel for each cylinder once every two revolutions.

When engine operating conditions are such that an increase in the number of fuel deliveries for each cylinder per cylinder cycle is required, an appropriate sensor such as potentiometer 102, signals the controller, and the suppression of pulses is temporarily stopped, and thus four pulses per revolution are available for activation of the solenoid valves and so each solenoid valve 108 may be activated twice every two revolutions that is twice each cylinder cycle. The controller may be arranged to control the number of cycles of the engine during which the increased number of pulses are applied to the solenoids.

The controller may also be arranged to provide an increase in the number of deliveries of fuel to one or some of the four cylinders over a duration less than one cycle such as when the increase in demand on the engine is relatively small. This may also apply where the metering system responses rapidly increase the metered quantity of fuel per solenoid cycle.

In the preceding example an individual solenoid is provided to control each metering chamber; however, where the fuel is delivered into the induction passage as distinct from directly into each cylinder, the timing of the delivery relative to the cylinder cycle is not critical. Thus fuel for a number of cylinders may be delivered at the same time into the induction passage. In such a system individual solenoids for each metering chamber are not required. Acceptable performance has been obtained using only two solenoids each controlling two metering chambers, so a metered quantity of fuel is delivered for two cylinders each solenoid cycle. It is possible to use only one solenoid to control four metering chambers with a metered quantity of fuel being delivered for all four cylinders each solenoid cycle. However, the response to transient engine condition is reduced as variations in the fuel supply are effected at relatively longer time intervals.

In the preceding description reference has been made to cylinders of engines which infers that the engine is a reciprocating piston engine, however, it is to be understood that the present invention is applicable to all types of internal combustion engines.

The claims defining the invention are as follows, I claim:

1. In a method of delivering a series of discrete, metered quantities of fuel for delivery to an engine comprising filling a metering chamber with fuel, admitting gas to the chamber at a pressure sufficient to displace the fuel from the chamber, displacing the fuel from the chamber by the admitted gas upon selective opening of a discharge port in communication with the chamber, and concontrolling the quantity of fuel displaceable by each admission of the gas to the chamber by adjusting the relative positions of the entry of the gas to and of the discharge of the fuel from the chamber between the positions, the improvement comprising delivering a base number of deliveries of discrete, metered quantities of fuel per engine cycle by generating a plurality of pulses per engine cycle, said pulses if not suppressed being capable of controlling the displacement of fuel from the chamber, suppressing a proportion of the pulses, and utilizing the pulses not suppressed to cause the said displacement of fuel from the chamber, and recognizing substantial engine load variations with resulting substantial engine fuel demand changes, such as acceleration of the engine, low engine temperature or cranking at starting, to deliver more fuel to the engine than could be rapidly accomplished by said control of the quantity of displaceable fuel by delivering additional metered quantities of fuel to said engine, until the control of the quantity of displaceable fuel becomes effective to meet the new engine load, by increasing the number of deliveries per engine cycle of the metered quantities of fuel above said base number of deliveries by including at least some of the pulses suppressed during delivery of said base number of deliveries to increase the number of pulses causing displacement of fuel from the chamber per engine cycle.

2. Method of claim 1, wherein two pulses are generated per engine cycle, with one of the pulses per cycle suppressed during delivery of said base number of deliveries, which base number is one delivery per engine cycle, and the number of pulses causing fuel displacement, and the number of fuel deliveries, is two per engine cycle during substantial increased engine fuel demand.

* * * * *